US008070462B2

(12) United States Patent
Inoue

(10) Patent No.: US 8,070,462 B2
(45) Date of Patent: Dec. 6, 2011

(54) HIGH-PRESSURE FUEL PUMP

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 880 days.

(21) Appl. No.: 11/797,960

(22) Filed: May 9, 2007

(65) Prior Publication Data

US 2007/0286742 A1 Dec. 13, 2007

(30) Foreign Application Priority Data

May 26, 2006 (JP) ..... 2006-146306

(51) Int. Cl.
*F04B 49/00* (2006.01)

(52) U.S. Cl. ..... 417/307; 417/454; 123/446

(58) Field of Classification Search ..... 417/307, 417/454; 123/446, 456
See application file for complete search history.

(56) References Cited

U.S. PATENT DOCUMENTS 5,370,096 A * 12/1994 Cooke ..... 123/502
5,715,798 A * 2/1998 Bacon et al. ..... 417/307
6,135,090 A 10/2000 Kawachi et al.
6,554,590 B2 * 4/2003 Maeda et al. ..... 417/505
2003/0219346 A1 * 11/2003 Abe et al. ..... 417/307

FOREIGN PATENT DOCUMENTS

| | | |
|---|---|---|
| JP | 2003-247474 | 9/2003 |
| JP | 2003-343395 | 12/2003 |
| JP | 2004-138062 | 5/2004 |
| JP | 2004-218547 | 8/2004 |

* cited by examiner

*Primary Examiner* — Devon C Kramer
*Assistant Examiner* — Peter J Bertheaud
(74) *Attorney, Agent, or Firm* — Nixon & Vanderhye PC

(57) ABSTRACT

A high-pressure fuel pump is disclosed that includes a pump housing with a suction port hole for defining a suction port, a pressure chamber for sucking fuel from the suction port, and a delivery port hole for defining a delivery port delivering fuel pressurized in the pressure chamber. The fuel pump also includes a plunger for pressurizing fuel sucked in the pressure chamber due to reciprocal motion of the plunger. Furthermore, the fuel pump includes a relief valve provided in the suction port hole, wherein the relief valve opens when a delivery pressure of the fuel delivered from the delivery port exceeds a predetermined pressure, thereby reducing the delivery pressure of the fuel.

9 Claims, 7 Drawing Sheets

HIGH-PRESSURE FUEL PUMP

CROSS REFERENCE TO RELATED APPLICATION

The following is based on and claims priority to Japanese Patent Application No. 2006-146306, filed May 26, 2006, which is hereby incorporated by reference in its entirety.

FIELD

The following relates to a high-pressure fuel pump which regulates a fuel delivery pressure to a predetermined pressure by a relief valve.

BACKGROUND INFORMATION

High-pressure fuel pumps are known for pressurizing fuel sucked in a pressure chamber by reciprocal motion of a plunger, in which, when a fuel delivery pressure is more than a predetermined pressure, a relief valve opens to reduce the fuel delivery pressure. This type of fuel pump is disclosed, for example, in JP-2003-247474A, JP-11-200990A and JP-2004-138062A. However, manufacture of this conventional high-pressure pump provided with such a relief valve can be overly time-consuming.

For example, since an exclusive hole for accommodating the relief valve is formed in a pump housing in JP-2003-247474A, JP-11-200990A and JP-2004-138062A, manufacturing time for forming the accommodating hole of the relief valve increases. In addition, since the relief valve is accommodated in the exclusive hole, it may be required to seal the accommodating hole of the relief valve or a clearance between the accommodating hole and the relief valve with a sealing member or the like in addition to sealing locations other than the accommodation location of the relief valve. This results in an increase in the number of sealing locations of the relief valve, thereby increasing manufacturing time for sealing.

In addition, in fuel pumps with a relief valve in an exclusive hole of a housing (see, e.g., FIG. 2 of JP-11-200990A), the housing is divided into a plurality of housing members for accommodating the relief valve. When the pump housing includes a plurality of the housing members for accommodating the relief valve, a clamping member or the like is used to assemble the housing members with each other, thereby increasing the assembly time of the pump housing.

In addition, for discharging the delivery fuel from the relief valve, a fuel discharge passage is included for communicating a delivery port with a delivery port side of the relief valve. However, it is difficult to form such a fuel discharge passage inside the pump housing. Therefore, manufacturing becomes more difficult and more time consuming.

In addition, when the fuel discharge passage is formed exclusively for discharging the delivery fuel from the relief valve, the manufacture time for forming the fuel discharge passage in the pump housing increases.

In this way, the manufacturing time and the sealing time of the accommodating hole in the relief valve, the assembly time of the pump housing, and the manufacturing time of the fuel discharge passage is significant, and as a result, manufacturing time of the high-pressure fuel pump is significant.

Further, decreasing the size of the conventional high-pressure fuel pump can be difficult.

For instance, in a case of accommodating a relief valve in an exclusive hole, a space for forming the exclusive hole is included in the pump housing, thereby increasing the size of the pump housing. In addition, in a case of sealing a clearance between the exclusive hole of the relief valve and the relief valve with a sealing member such as an O-ring, a location space for the sealing member is included, therefore increasing the size of the pump housing.

Further, in a structure of clamping a plurality of housing members for accommodating the relief valve, a seal dimension in the assembling location of the housing members each other is substantially long, thereby increasing the size of the pump housing.

In view of the above, there remains a need for a high-pressure fuel pump that overcomes the above mentioned problems in the conventional art. The present disclosure addresses this need in the conventional art as well as other needs, which will become apparent to those skilled in the art.

SUMMARY

A high-pressure fuel pump is disclosed that includes a pump housing with a suction port hole for defining a suction port, a pressure chamber for sucking fuel from the suction port, and a delivery port hole for defining a delivery port delivering fuel pressurized in the pressure chamber. The fuel pump also includes a plunger for pressurizing fuel sucked in the pressure chamber due to reciprocal motion of the plunger. Furthermore, the fuel pump includes a relief valve provided in the suction port hole. The relief valve opens when a delivery pressure of the fuel delivered from the delivery port exceeds a predetermined pressure, thereby reducing the delivery pressure of the fuel.

A high-pressure fuel pump is also disclosed that includes a pump housing with a suction port, a pressure chamber for sucking fuel from the suction port, and a delivery port for delivering fuel pressurized in the pressure chamber. The fuel pump also includes a plunger for pressurizing fuel sucked in the pressure chamber due to reciprocal motion of the plunger. The fuel pump further includes a relief valve accommodated in an accommodating hole of the pump housing. The relief valve opens when a delivery pressure of the fuel delivered from the delivery port exceeds a predetermined pressure, thereby reducing the delivery pressure of the fuel. The pump housing further includes a fuel discharge passage that extends from an outer peripheral surface of the pump housing to communicate the delivery port with a delivery port side of the relief valve.

Moreover, a high-pressure fuel pump is disclosed that includes a pump housing with a suction port, a pressure chamber for sucking fuel from the suction port, a fuel chamber formed between the suction port and the pressure chamber, and a delivery port for delivering fuel pressurized in the pressure chamber. A plunger is also included for pressurizing fuel sucked in the pressure chamber due to reciprocal motion of the plunger. Furthermore, the fuel pump includes a relief valve accommodated in an accommodating hole of the pump housing. The relief valve opens when a delivery pressure of the fuel delivered from the delivery port exceeds a predetermined pressure, thereby reducing the delivery pressure of the fuel. A fuel discharge passage provides communication between a plunger accommodating hole that accommodates the plunger with the fuel chamber. Additionally, a fuel discharge passage provides communication between the relief valve and the fuel chamber. The fuel discharge passage and the fuel discharge passage are used in common.

BRIEF DESCRIPTION OF THE DRAWINGS

Other objects, features, and advantages of the present disclosure will become more apparent from the following detailed description made with reference to the accompanying drawings, in which like parts are designated by like reference numbers and in which.

DETAILED DESCRIPTION OF THE EXAMPLE EMBODIMENTS

A plurality of embodiments will be hereinafter described with reference to the accompanying drawings.

First Embodiment

Figure 1:
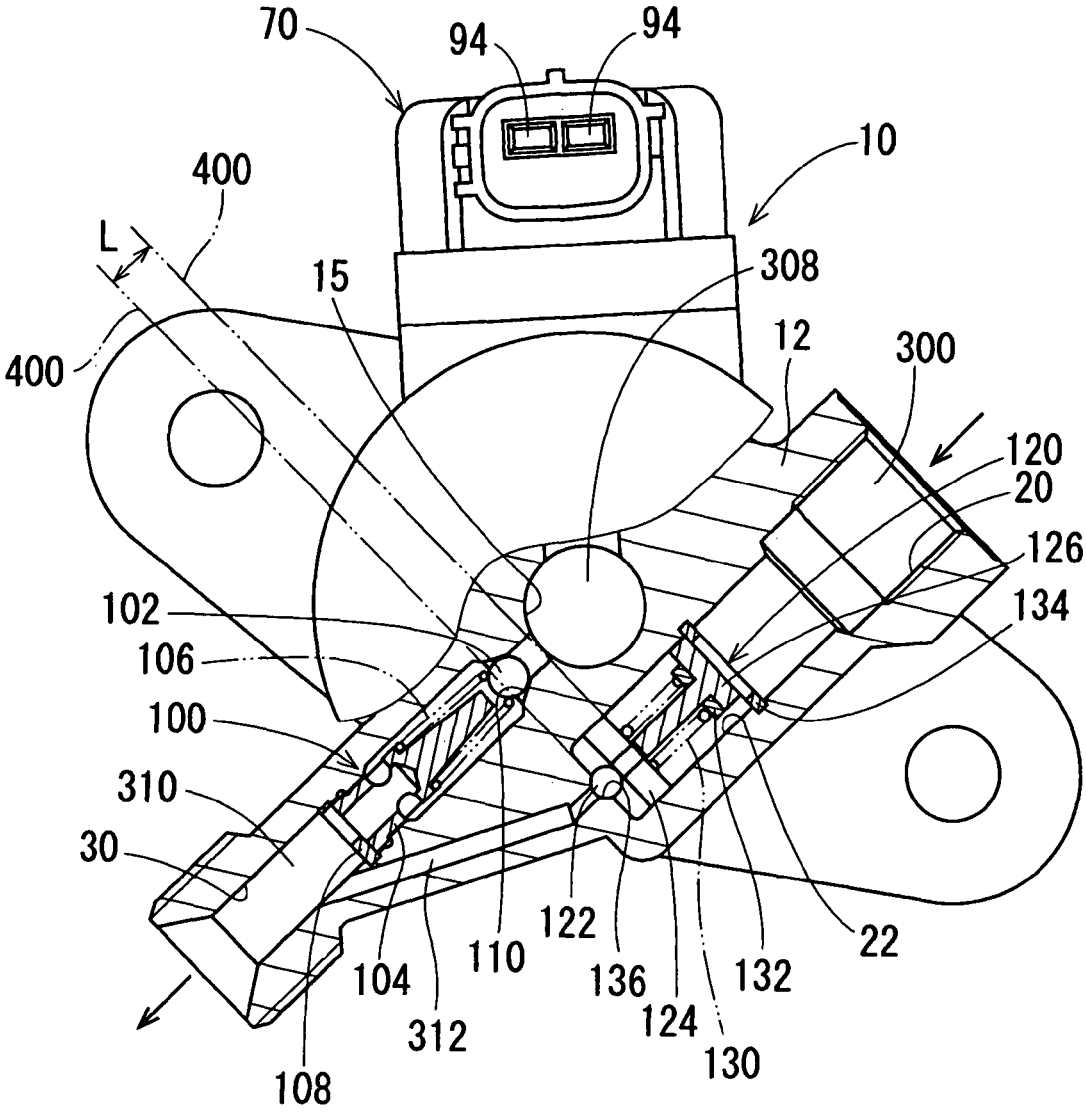
FIG. 1 is a transverse cross sectional view of a high-pressure fuel pump in a first embodiment.
Figure 2A:
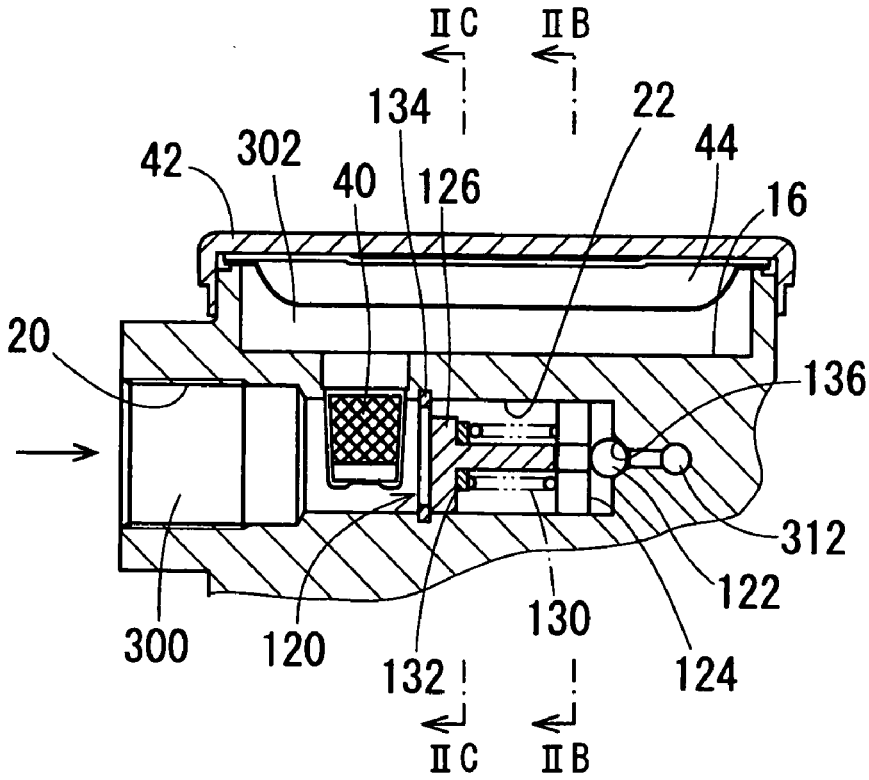
FIG. 2A is a cross sectional view of a suction port hole including a relief valve of the fuel pump of FIG. 1.
Figure 2B:
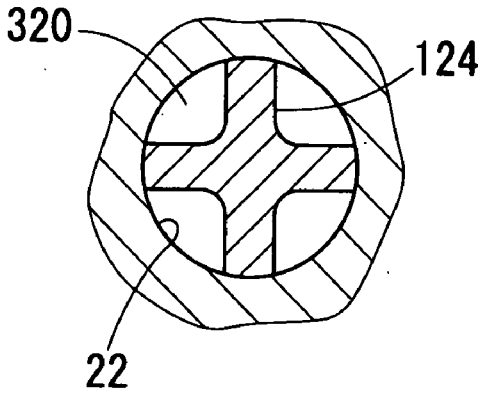
FIG. 2B is a cross sectional view of the fuel pump of FIG. 2A taken on line IIB-IIB.
Figure 2C:
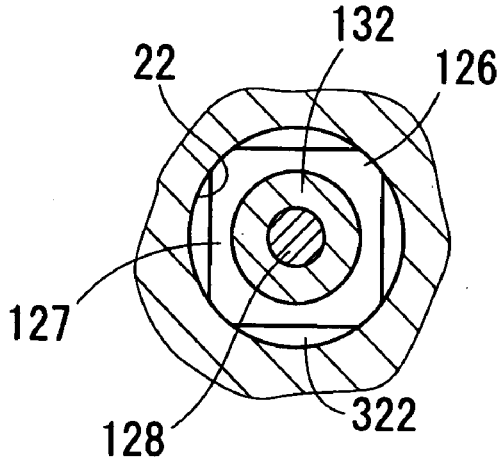
FIG. 2C is a cross sectional view of the fuel pump of FIG. 2A taken on line IIC-IIC in FIG. 2A.
Figure 3:
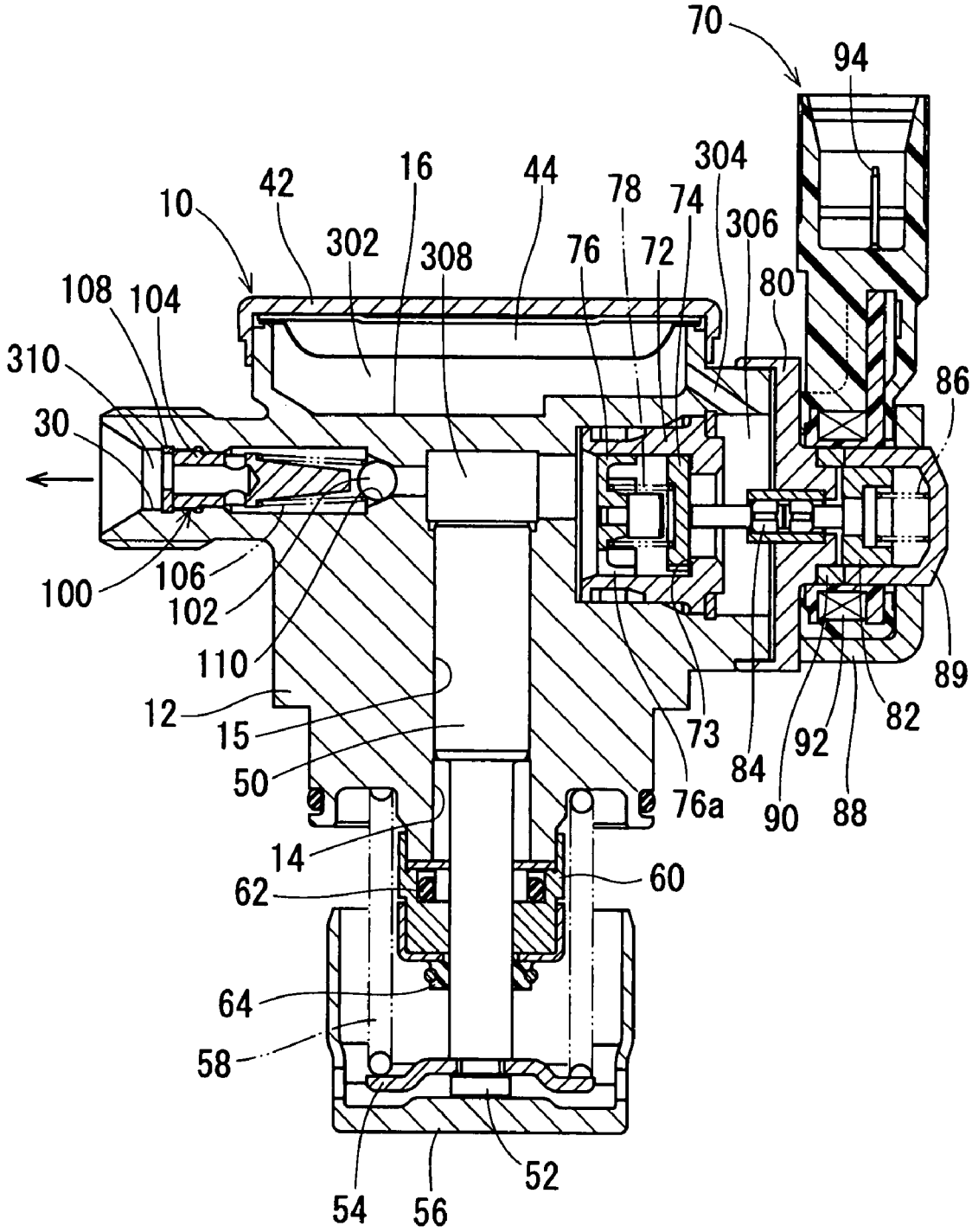
FIG. 3 is a longitudinal cross sectional view of the fuel pump of FIG. 1.

FIGS. 1 to 3 show a high-pressure fuel pump in a first embodiment of the present disclosure. A high-pressure fuel pump 10 is a pump for supplying fuel to, for example, an injector of a diesel engine or a gasoline engine. The fuel supplied from a low-pressure pump (not shown) to a suction port 300 flows through a filter 40 and is sucked in a pressure chamber 308 through a fuel chamber 302, a communicating passage 304 and a fuel gallery 306 in that order. The fuel pressurized in the pressure chamber 308 is supplied from a delivery port 310 to a fuel rail or the like. The direction of fuel flow is illustrated at various locations in the figures by an arrow.

A pump housing body 12 is included that is integrally formed by an iron material such as a stainless iron. A cover 42 is also included that is coupled to the housing body 12. The housing body 12 includes a cylinder 15 formed therein. Also, the entire housing body 12 is hardened for increasing hardness. In a case where the high-pressure fuel pump 10 is used in a diesel engine, the housing body 12 may be formed with a non-stainless iron member. The housing body 12 is also provided with a plunger accommodating hole 14 formed therein which accommodates a plunger 50 in such a manner as to reciprocate therein. The plunger accommodating hole 14 is integral with the cylinder 15 reciprocally supporting the plunger 50. In addition, the housing body 12 is provided with a suction port hole 20 and a delivery port hole 30 formed therein. The suction port hole 20 defines the suction port 300, and the delivery port hole 30 defines the delivery port 310.

The fuel chamber 302 is defined by a concave portion 16 formed in the housing body 12 and the cover 42. The fuel chamber 302 is formed substantially coaxially with the plunger 50 at a side opposite to the pressure chamber 308 in an axial direction of the plunger 50 and expands in a radial, outer side of the pressure chamber 308.

A pulsation damper 44 is retained between the cover 42 and the housing body 12. The pulsation damper 44 is flexibly deformed in response to a fuel pressure in the fuel chamber 302 and reduces a pressure pulsation of fuel sucked from the fuel chamber 302 to the pressure chamber 308. The communicating passage 304 communicates the fuel chamber 302 with the fuel gallery 306 of an electromagnetic valve 70.

The plunger 50 is reciprocally supported in the cylinder 15 of the housing body 12. The pressure chamber 308 is formed at one end side in a reciprocal motion direction of the plunger 50. The plunger 50 has an outer peripheral face which is sealed by oil seals 62, 64 supported by a support member 60 between a side of the head 52 of the plunger 50 and a side of the cylinder 15. The oil seals 62, 64 reduce leakage of oil from an engine into the pressure chamber 308 and also reduce fuel leakage from the pressure chamber 308 into the engine. The head 52 formed at the other side of the plunger 50 is joined to a spring seat 54. The head 52 of the plunger 50 abuts the bottom inner wall of a tappet 56 due to a load from a spring 58. A bottom outer wall of the tappet 56 slides on a pump cam (not shown) by rotation of the pump cam, creating a reciprocal motion of the plunger 50.

The electromagnetic valve 70 connects/disconnects communication between the fuel gallery 306 and the pressure chamber 308 depending on ON/OFF of power supply to a coil 92. The electromagnetic valve 70 is a metering valve for metering a fuel delivery amount by controlling the power supply timing to the coil 92. The fuel gallery 306 is communicated with the fuel chamber 302 through the communicating passage 304.

A valve body 72 of the electromagnetic valve 70 is attached to the housing body 12 between the fuel gallery 306 and the pressure chamber 308. When a valve member 74 is seated on a valve seat 73 of the valve body 72, the communication between the fuel gallery 306 and the pressure chamber 308 is blocked. A spring seat 76 is attached inside the valve body 72 and is in contact with one end of a spring 78. The other end of the spring 78 is in contact with the valve member 74. The spring 78 applies a load to the valve member 74 in such a valve closing direction as to make the valve member 74 seated on the valve seat 73. The spring seat 76 is provided with a fuel aperture **76*a* formed therein for communicating the fuel gallery 306 with the pressure chamber 308**.

A stationary core 80 is included that has a cup shape and is joined to the housing body 12 by means of laser welding or the like. A movable core 82 is located at the opposite side of the stationary core 80 to the valve member 74 and faces the stationary core 80. A rod 84 is inserted through the central portion of the stationary core 80. In addition, the rod 84 is connected to the movable core 82 by means of laser welding or the like and reciprocates with the movable core 82. The spring 86 is in contact with one end of the rod 84 and applies a load to the rod 84 in the direction where the movable core 82 moves toward the stationary core 80, that is, toward the valve member 74. In a state where the rod 84 is in contact with the valve member 74, the load of the spring 86 acts in the valve opening direction of making the valve member 74 move away from the valve seat 73.

When a load of the spring 86 is set as F1 and a load of the spring 78 is set as F2, each load is set such that F1 is less than F2 (i.e., $F1<F2$). The valve member 74 is pressed in the direction of being seated on the valve seat 73 due to a difference in load between the spring 78 and the spring 86. Therefore, the valve member 74 is biased so as to be seated on the valve seat 73.

Yokes 88, 89 cover an outer periphery of the coil 92 and form a magnetic circuit with the stationary core 80 and the movable core 82. A tubular non-magnetic member 90 is located between the stationary core 80 and the yoke 89 for preventing shortcut of the magnetic flux between the stationary core 80 and the yoke 89. The coil 92 is wound around an outer periphery of each of the stationary core 80, the yoke 89 and the non-magnetic member 90. A terminal 94 is connected electrically to the coil 92 and supplies power to the electromagnetic valve 70.

A ball 102, a spring seat 104, a spring 106, and a C-ring 108 of a delivery valve 100 are accommodated in the delivery port hole (bore) 30. The housing body 12 serves also as the valve housing of the delivery valve 100 and a valve seat 110 which the ball 102 is seated on is formed in the housing body 12. The delivery valve 100 is located laterally to an axis of the high-pressure fuel pump 10 and is located radially to the central axis of the high-pressure fuel pump 10. The C-ring 108 prevents the spring seat 104 from falling out of the delivery port 310. When pressure in the pressure chamber 308 rises to more than a predetermined pressure, the ball 102 lifts from the valve seat 110 against the load of the spring 106, and high-pressure fuel in the pressure chamber 308 is delivered from the delivery port 310.

As shown in FIG. 1, a ball 122, a guide 124, a spring seat 126, a spring 130, a shim 132, and a C-ring 134 of the relief valve 120 are accommodated in the relief valve-accommodating portion 22 of the suction port hole (bore) 20. The relief valve-accommodating portion 22 is formed coaxially with the suction port 300 in the depth of the suction port hole 20. The housing body 12 serves also as the valve housing of the relief valve 120 and a valve seat 136 on which the ball 122 is seated is formed in the housing body 12.

As shown in FIG. 2, the guide 124 is formed in a cross shape and receives a load directed toward the ball 122 from the spring 130. In addition, the guide 124 guides the ball 122 while sliding on the relief valve-accommodating portion 22 and reciprocates with the ball 122. A fuel passage 320 is formed between the guide 124 and the relief valve-accommodating portion 22.

The spring seat 126 includes a plate portion 127 and a rod 128. The plate portion 127 abuts the C-ring 134 due to the spring load. The rod 128 extends toward the guide 124. A lift amount of the ball 122 is restricted by contact of the guide 124 with the rod 128. The circumference of the plate portion 127 is cut away linearly and a fuel passage 322 is formed between the plate portion 127 and the relief valve-accommodating portion 22.

The shim 132 is inserted in the rod 128 of the spring seat 126 and is retained between the plate portion 127 of the spring seat 126 and the spring 130. A load of the spring 130 applied to the guide 124 and the ball 122 can be adjusted by adjusting the thickness or the number of the shim 132. The C-ring 134 is fitted in the circular groove formed in an inner wall of the relief valve-accommodating portion 22 and prevents the spring seat 126 from falling out of the relief valve-accommodating portion 22.

The relief valve 120 is communicated in the side of the delivery port 310 with the delivery port 310 through a fuel discharge passage 312. The fuel discharge passage 312 is formed obliquely from the half way of the delivery port 310 toward the relief valve 120. When the fuel pressure delivered from the delivery port 310 rises to more than a predetermined pressure, the ball 122 lifts from the valve seat 136 against the load of the spring 130 and a portion of the delivery fuel flows through the delivery port 310, the fuel discharge passage 312, and the relief valve 120 in that order and is discharged to the side of the suction port 300. As a result, the delivery pressure of the fuel delivered from the delivery port 310 is reduced in such a manner as not to exceed the predetermined pressure. A valve opening pressure of the relief valve 120 is higher than that of the delivery valve 100.

In addition, as shown in FIG. 1, when the delivery port 310 is viewed from the side direction to the axis of the high-pressure fuel pump 10 along a reciprocal motion direction of the plunger 50, the relief valve-accommodating portion 22 and the delivery port hole (bore) 30 axially overlap by a distance L, indicated by two broken lines 400.

In addition, the relief valve 120 extends laterally relative to the axis of the high-pressure fuel pump 10 and is offset from the axis of the delivery port hole (bore) 30. In this embodiment, the delivery port hole 30 provides a communication between the pressure chamber 308 and an area outside the housing body 12 for delivering fuel from the pressure chamber 308 to the delivery port 310.

Next, an operation of the high-pressure fuel pump 10 will be explained.

(1) Suction Stroke

When the plunger 50 descends to reduce a pressure in the pressure chamber 308, the valve member 74 receives a pressure difference between the gallery 306 as the side of the fuel inlet of the valve member 74 and the pressure chamber 308 as the side of the fuel outlet varies. When the sum of forces received by the valve member 74 toward the valve seat 73 due to a fuel pressure in the pressure chamber 308 and load from the spring 78 becomes smaller than the sum of force on the valve member 74 directed away from the valve seat 73 due to a fuel pressure in the fuel gallery 306 and a load of the spring 86, the valve member 74 moves away from the valve seat 73. As a result, the fuel flows through the fuel chamber 302, the communicating passage 304 and the fuel gallery 306 in that order and is sucked into the pressure chamber 308. When the valve member 74 moves away from the valve seat 73, the rod 84 moves toward the valve member 74 due to the load of the spring 86, and the movable core 82 moves toward the stationary core 80. When the movable core 82 contacts the stationary core 80, the movable core 82 and the rod 84 cease movement. In a state in which the movable core 82 abuts the stationary core 80, the tip of the rod 84 at the side of the valve member 74 protrudes to a side closer to the valve member 74 than the valve seat 73.

In addition, before the plunger 50 reaches the bottom dead center or when the plunger 50 reaches the bottom dead center, power supply to the coil 92 turns on in a state in which the movable core 82 abuts the stationary core 80. Since the power supply to the coil 92 turns on in a state where the movable core 82 abuts the stationary core 80, even if a current value supplied to the coil 92 is small, a large magnetic suction force acts between the stationary core 80 and the movable core 82. Therefore, even if the current value supplied to the coil 92 is small, the state where the movable core 82 abuts the stationary core 80 can be held.

(2) Return Stroke

Even if the plunger 50 lifts from the bottom dead center to the top dead center, since the power supply to the coil 92 is ON and the magnetic suction force acts between the stationary core 80 and the movable core 82, the movable core 82 is held at a position to abut the stationary core 80. That is, since the valve member 74 is blocked by the rod 84 to be held at the valve opening position spaced from the valve seat 73, with the lifting of the plunger 50 the fuel in the pressure chamber 308 flows through the fuel gallery 306 and the communicating passage 304, and then returns back to the fuel chamber 302.

(3) Pressure Applying Stroke

When the power supply to the coil 92 is OFF during a return stroke, the magnetic suction force does not act between the stationary core 80 and the movable core 82. As a result, the valve member 74 moves toward the valve seat 73 (i.e., toward the right as shown in FIG. 3), which is the valve opening direction, and is then seated on the valve seat 73 due to a difference in load between the spring 78 and the spring 86 and a fluid force when the fuel in the pressure chamber 308 flows through the fuel gallery 306 and the communicating passage 304 and is back to the fuel chamber 302 with the lifting of the plunger 50. Therefore, the communication between the fuel gallery 306 and the pressure chamber 308 is blocked. When the plunger 50 moves further up toward the top dead center under this condition, the fuel in the pressure chamber 308 is pressurized to increase the fuel pressure therein. Then, when the fuel pressure in the pressure chamber 308 exceeds a predetermined pressure, the ball 102 of the delivery valve 100 moves away from the valve seat 110 against the biasing force of the spring 106 to thereby open the delivery valve 100. As a result, the fuel pressurized in the pressure chamber 308 is delivered from the delivery port 310. The fuel delivered from the delivery port 310 is supplied and accumulated in the fuel rail (not shown), and then is supplied to a fuel injector.

When the fuel pressure delivered from the delivery port 310 exceeds a valve opening pressure of the relief valve 120, the ball 122 moves away from the valve seat 136 against the load of the spring 130 to thereby open the relief valve 120. When the relief valve 120 is opened, the high pressure in the delivery port 310 flows through the fuel discharge passage 312, the fuel passages 320 and 322 of the relief valve 120, and then is discharged to the side of the suction port 300. As a result, a delivery pressure of the fuel delivered from the delivery port 310 is reduced.

Repetition of the above strokes from (1) to (3) causes the high-pressure fuel pump 10 to pressurize and deliver the sucked fuel. A delivery amount of the fuel is adjusted by controlling power supply timing of the electromagnetic valve 70 to the coil 92.

According to the first embodiment, since the relief valve 120 is accommodated in the relief valve-accommodating portion 22 formed in the depth of the suction port hole 20 defining the suction port 300, it is not required to further form an exclusive hole in the housing body 12 for accommodating the relief valve 122. As a result, the manufacturing time and effort is reduced for the high-pressure fuel pump 10. Accordingly, the manufacturing costs of the high-pressure fuel pump 10 can be reduced.

In addition, since the relief valve-accommodating portion 22 is formed coaxially with the suction port 300 through the suction port hole 20, the relief valve-accommodating portion 22 and the suction port 300 can be processed coaxially. Therefore, it is easier to process the housing body 12.

Since the housing body 12 serves also as the valve housing of the relief valve 120, the number of components of the relief valve 120 is reduced to enable downsizing of the housing body 12.

In addition, since the relief valve 120 is located laterally relative to the axis of the fuel pump, it is possible to shorten an axial length of the high-pressure fuel pump 10.

In addition, when the relief valve 120 opens, the fuel is discharged from the relief valve 120 to the side of the suction port 300. According to this structure, for accommodating the relief valve 120 in the high-pressure fuel pump 10, a sealing member in the housing body 12 is unnecessary and therefore, the number of the seal locations in the high-pressure fuel pump 10 is reduced. This leads to a reduction in the number of components in the sealing member and a reduction in manufacturing time for locating and providing the seal member. Therefore, this leads to a reduction in manufacturing time for the high-pressure fuel pump 10 and manufacturing costs thereof. In addition, since a space for locating the sealing member in the housing body 12 for the relief valve 120 is unnecessary in the pump housing 12, the housing body 12 and the fuel pump 10 itself can be more easily reduced in size. In addition, since a reduction in the number of the seal locations leads to a reduction in the number of locations for using a rubber member such as an O-ring as a sealing member, it can be restricted that an evaporated fuel is leaked through the sealing member.

In addition, since the relief valve 120 is located at a position spaced from the delivery port hole 30, the relief valve 120 can be located in a space of the housing body 12 to the side of the delivery port hole 30. Accordingly, the housing body 12 can be reduced in size.

Second Embodiment

Figure 4:
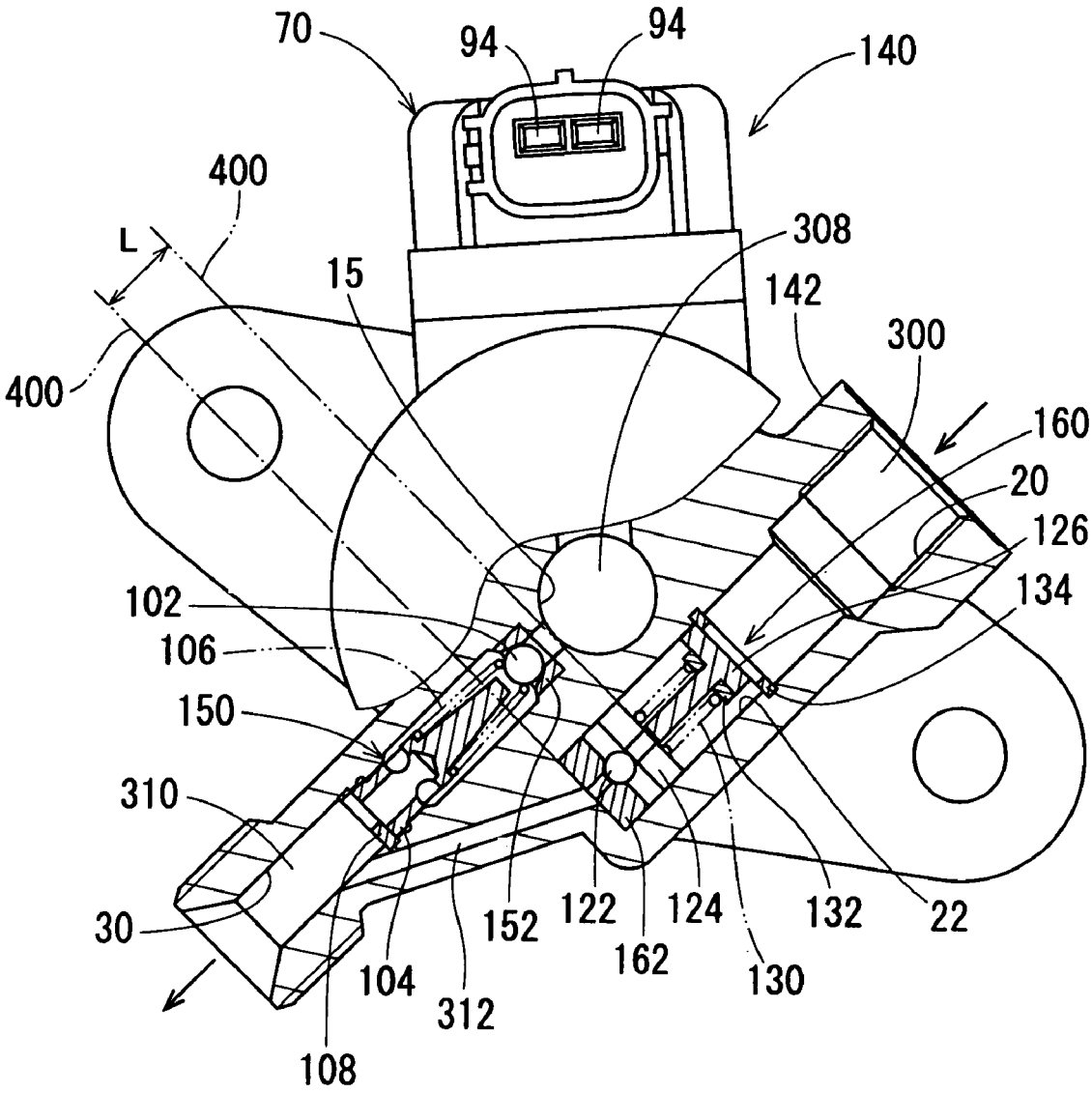
FIG. 4 is a transverse cross sectional view of a high-pressure fuel pump in a second embodiment.

FIG. 4 shows a second embodiment of the present disclosure. It should be noted that components that are similar to those of the first embodiment are identified with similar reference numerals.

In the second embodiment, the hardness of the cylinder 15 is ensured by selectively hardening only the cylinder 15 of a housing body 142 in a high-pressure fuel pump 140. In one embodiment, the cylinder 15 is a separate member from (i.e., non-integral to) the other portions the housing body 142. It is appreciated that it is difficult in terms of hardness to directly form valve seats of a delivery valve 150 and a relief valve 160 in the housing body 142. Therefore, in the second embodiment, the valve seat of the delivery valve 150 and the valve seat of the relief valve 160 are formed with valve seat members 152, 162 respectively higher in hardness than the housing body 142. The valve seat members 152, 162 are accommodated in the delivery port hole 30 and the relief valve-accommodating portion 22, respectively.

Third Embodiment

Figure 5A:
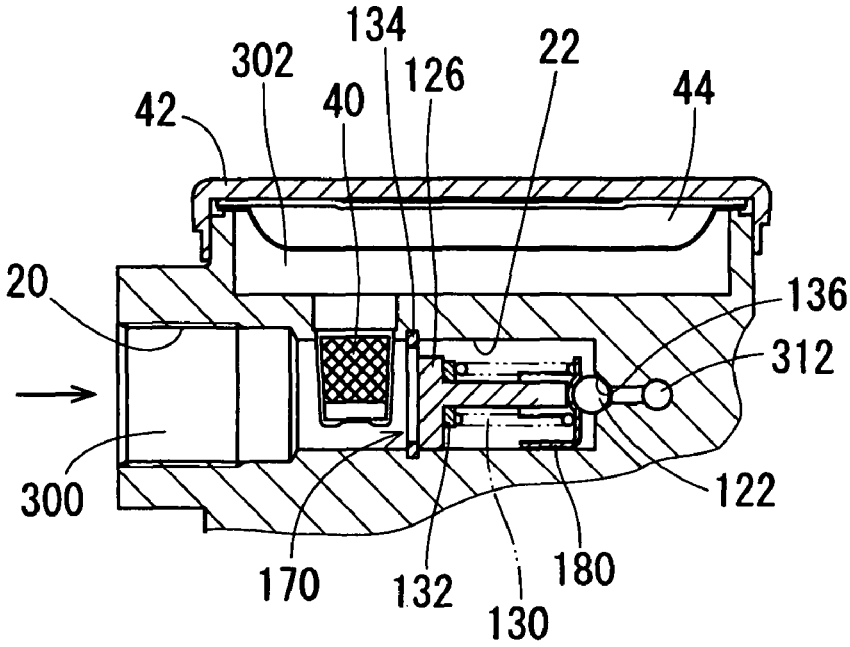
FIG. 5A is a cross sectional view of a suction port hole of a fuel pump in a third embodiment including a relief valve.
Figure 5B:
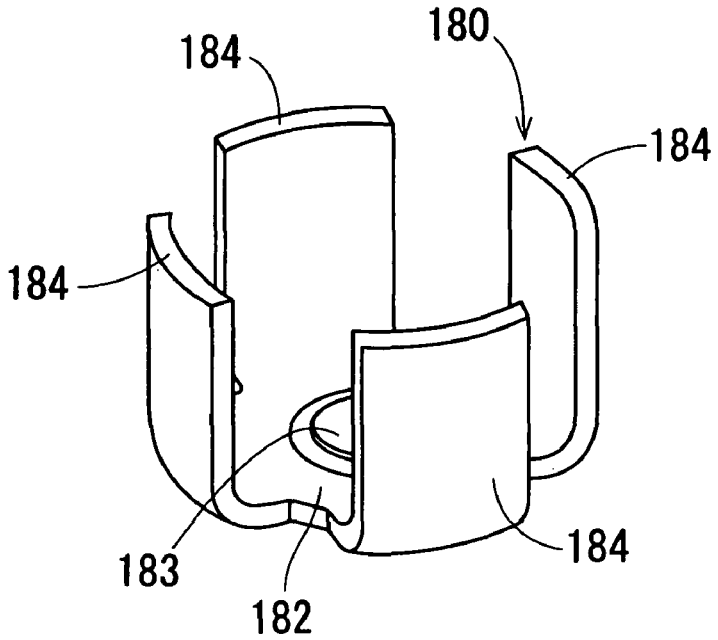
FIG. 5B is a perspective view showing a guide of the third embodiment.

FIGS. 5A and 5B show a third embodiment of the present disclosure. It should be noted that components that are similar to those of the first embodiment are identified with similar reference numerals.

In the third embodiment, a guide 180 for guiding a ball 122 of the relief valve 170 has a cup shape. The guide 180 has a bottom 182 that is contoured according to the size of the ball 122 as shown in FIG. 5. A fitting hole 183 extends through the bottom 182 with a diameter smaller than that of the ball 122. The ball 122 is fitted into the contoured portion of the bottom 182 and partially into the fitting hole 183. The guide 180 also includes a plurality of nails 184 extending away from the ball 122. In the embodiment shown, there are four nails 184 that are equally spaced around the periphery of the bottom 182. The guide 180 guides the ball 122 due to sliding of the nails 184 on the wall of the relief valve-accommodating portion 22 while reciprocating with the ball 122. In addition, at the opening of the relief valve 170, delivery fuel is discharged past the guide 180 through the spaces between the nails 184. In one embodiment, the guide 180 is formed by press working a plate member.

Fourth Embodiment

Figure 6:
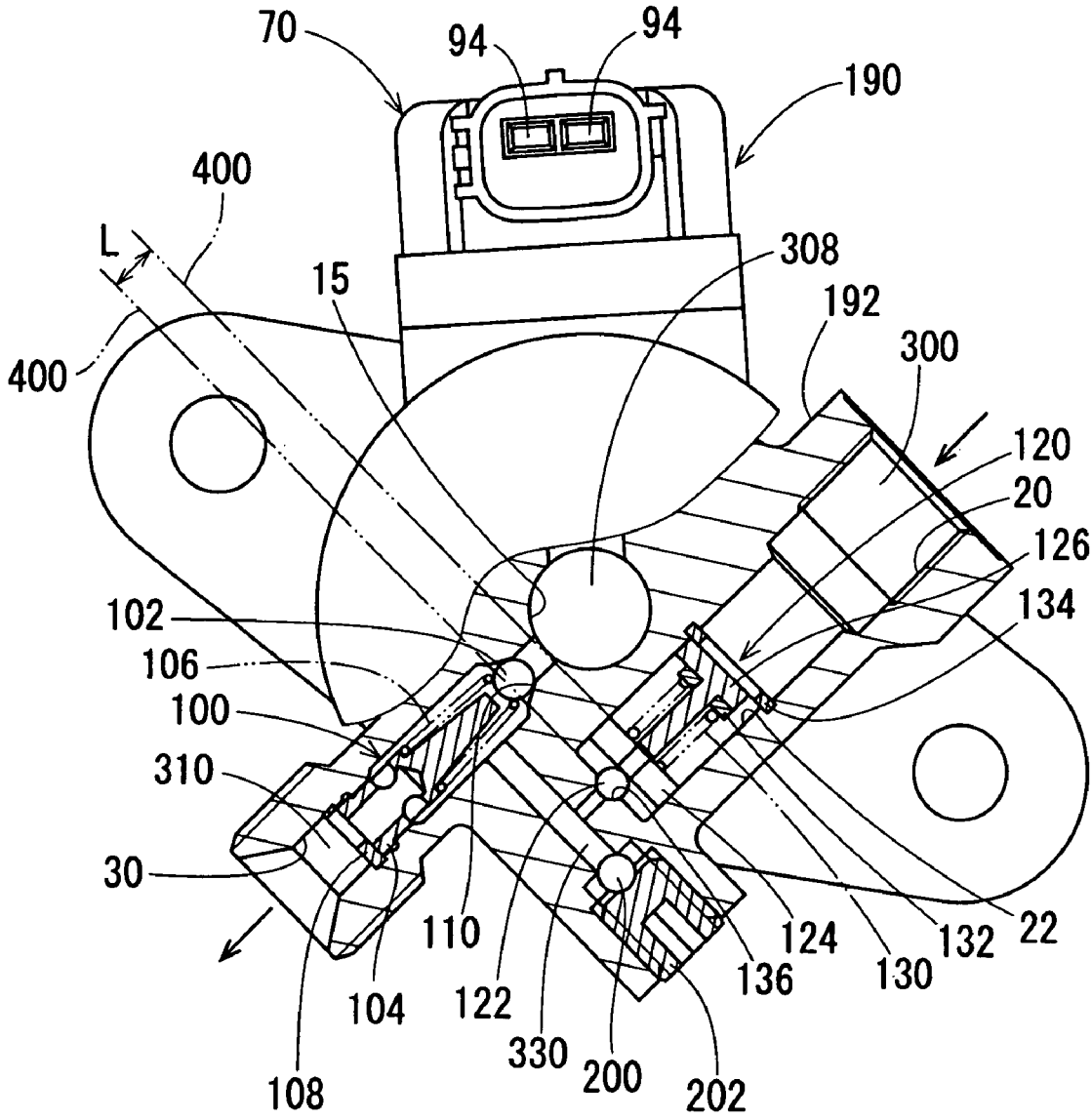
FIG. 6 is a transverse cross sectional view of a high-pressure fuel pump in a fourth embodiment.

FIG. 6 shows a fourth embodiment of the present disclosure. It should be noted that components that are similar to those of the first embodiment are identified with similar reference numerals.

In a high-pressure fuel pump 190 of the fourth embodiment, the housing body 192 includes a fuel discharge passage 330. The fuel discharge passage 330 provides communication between the delivery port 310 and the relief valve 120. The fuel discharge passage 330 extends to an outer peripheral face of the housing body 192. A closure screw 202 is also included that presses a ball 200 on a step of the fuel discharge passage 330 to close the fuel discharge passage 330.

In the fourth embodiment, the fuel discharge passage 330 extends to the outer peripheral face of the housing body 192. Thus, work and manufacture of the fuel discharge passage 330 may be easier as compared to the structure where the fuel discharge passage 312 extends from a mid-point of the delivery port 310 as in the case of the first embodiment.

Fifth Embodiment

Figure 7A:
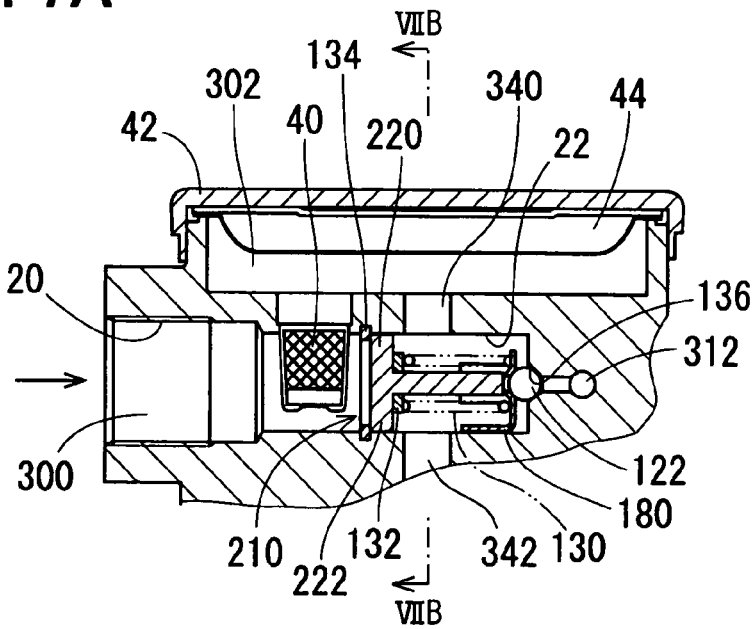
FIG. 7A is a cross sectional view of a suction port hole including a relief valve in a fuel pump of a fifth embodiment.
Figure 7B:
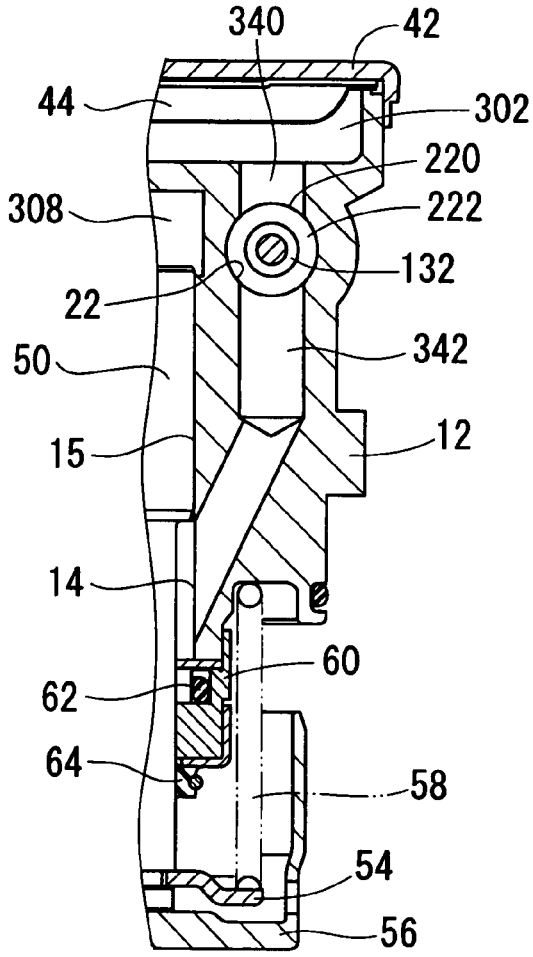
FIG. 7B is a cross sectional view taken on line VIIB-VIIB in FIG. 7A.

FIGS. 7A and 7B show a fifth embodiment of the present disclosure. It should be noted that components that are similar to those of the first embodiment are identified with similar reference numerals.

In the fifth embodiment, a fuel discharge passage 340 is included for communicating a relief valve 210 with a fuel chamber 302 to discharge a portion of the delivery fuel from the relief valve 210 to the fuel chamber 302, which is in the side of a suction port 300. Since it is not required to directly discharge the delivery fuel from the relief valve 210 toward the suction port 300, the notch for forming the fuel passage as in the case of the first embodiment is not included in a plate portion 222 of a spring seat 220 in this embodiment. As a result, the work and manufacture of the spring seat 220 is easier and therefore, manufacturing cost of the spring seat 220 is reduced.

In addition, the fuel discharge passage 342 extends through a relief valve-accommodation portion 22 and communicates a plunger accommodating hole 14 with the fuel chamber 302. The fuel flowing through a sliding portion between a plunger 50 and a cylinder 15 and leaked from a pressure chamber 308 to the sides of oil seals 62, 64 flows through the fuel discharge passage 342 and the relief valve 210, and then is discharged to the fuel chamber 302. A part of the fuel discharge passage 342 is used in common with the fuel discharge passage 340.

Since the fuel discharge passage 340 discharging the fuel to the fuel chamber 302 at the opening of the relief valve 210 is partially used in common with the fuel discharge passage 342 discharging the fuel leaked from the sliding portion between the cylinder 15 and the plunger 50 to the fuel chamber 302, the manufacturing time of the fuel discharge passage and the fuel pump is reduced.

Other Embodiments

In the above embodiments, the housing body serves also as the valve housing of the relief valve. In another embodiment, a relief valve sub-assembled by incorporating the valve housing may be accommodated in a suction port hole. Even in a case of accommodating the sub-assembled relief valve in the suction port hole, it is not required to further seal the suction port hole or a clearance between the suction port hole and the relief valve.

In the above embodiments, the housing body serves also as the valve housing of the delivery valve. In another embodiment, a delivery valve sub-assembled by incorporating the valve housing may be accommodated in a delivery port hole. In addition, in the above embodiments, the suction port hole 20 is formed so that the relief valve-accommodating portion 22 is located coaxially with the suction port 300. In another embodiment, an axis of the suction port 300 is offset from an axis of the relief valve-accommodating portion 22 to form the suction port hole. In addition, the relief valve-accommodating portion 22 may be located obliquely to the suction port 300 to form the suction port hole.

In addition, in the above embodiments, the relief valve and the delivery valve are located on the same plane. In another embodiment, the relief valve is located on a plane different from that of the delivery valve. Accordingly, for example, one of the relief valve and the delivery valve may be located longitudinally and the other may be located laterally. In addition, the relief valve does not deviate from the delivery port 310 and may be located radially to the central axis of the high-pressure fuel pump.

In another embodiment, as is different from the second embodiment, an accommodating hole of the relief valve other than the suction port hole is formed exclusively and a fuel discharge passage for communicating the delivery port with the side of the delivery port of the relief valve accommodated in the exclusive hole is formed from the outer peripheral face of the housing body.

In still another embodiment, as is different from the fifth embodiment, an accommodating hole of the relief valve other than the suction port hole is formed exclusively and a fuel discharge passage for discharging fuel from a plunger accommodating hole is used commonly with a fuel discharge passage for discharging delivery fuel from the relief valve accommodated in the exclusive hole.

In another embodiment, as is different from the fifth embodiment, the fuel discharge passage 332 for discharging fuel from the plunger accommodating hole 14 is not used commonly with the fuel discharge passage 330 for discharging delivery fuel from the relief valve 210 to the fuel chamber 302 and is formed in a route different from the fuel discharge passage 330.

While only the selected example embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the example embodiments according to the present disclosure is provided for illustration only, and not for the purpose of limiting the disclosure as defined by the appended claims and their equivalents.

What is claimed is:

1. A high-pressure fuel pump comprising:

a pump housing including a suction port bore for defining a suction port, a pressure chamber for sucking fuel from the suction port and a delivery port bore for defining a delivery port delivering fuel pressurized in the pressure chamber, the suction port bore and the delivery port bore each having a longitudinal axis defined in the same plane;

a plunger for pressurizing fuel sucked in the pressure chamber due to reciprocal motion of the plunger; and a relief valve provided coaxially in the suction port bore, wherein the relief valve opens when a delivery pressure of the fuel delivered from the delivery port exceeds a predetermined pressure, thereby reducing the delivery pressure of the fuel, wherein the suction port bore and the delivery port bore directly communicate with each other through said relief valve via a fuel discharge passage, said fuel discharge passage having a longitudinal axis entirely included in the same plane as the axes of the suction port bore and the delivery port bore.

2. A high-pressure fuel pump according to claim 1, wherein the pump housing serves also as a valve housing of the relief valve.

3. A high-pressure fuel pump according to claim 1, wherein a relief valve-accommodating portion of the suction port bore for accommodating the relief valve axially overlaps with the delivery port bore.

4. A high-pressure fuel pump according to claim 1, wherein the relief valve is laterally offset from an axis of the high-pressure fuel pump.

5. A high-pressure fuel pump according to claim 1, wherein the relief valve is axially offset from the delivery port bore.

6. A high-pressure fuel pump according to claim 1, wherein the fuel discharge passage extends from an outer peripheral surface of the pump housing to communicate the delivery port bore with a delivery port side of the relief valve.

7. A high-pressure fuel pump comprising:

a pump housing including a suction port bore, a pressure chamber for sucking fuel from the suction port bore and a delivery port bore for delivering fuel pressurized in the pressure chamber, the suction port bore and the delivery port bore each having a longitudinal axis defined in the same plane;

a plunger for pressurizing fuel sucked in the pressure chamber due to reciprocal motion of the plunger; and a relief valve accommodated in an accommodating bore which forms a part of the suction port bore of the pump housing, the relief valve opening when a delivery pressure of the fuel delivered from the delivery port bore exceeds a predetermined pressure, thereby reducing the delivery pressure of the fuel, wherein:

the pump housing further includes a fuel discharge passage that extends from an outer peripheral surface of the pump housing for direct communication between the delivery port bore and the suction port bore through the fuel discharge passage and the relief valve, and the fuel discharge passage having a longitudinal axis entirely included in the same plane as the axes of both (a) the suction port bore and (b) the delivery port bore.

8. The high-pressure fuel pump of claim 1, wherein the relief valve in the suction port bore and the delivery port bore axially overlap with each other.

9. The high-pressure fuel pump of claim 7, wherein the relief valve in the suction port bore and the delivery port bore axially overlap with each other.

* * * * *